US007574758B2

(12) United States Patent
Arason et al.

(10) Patent No.: US 7,574,758 B2
(45) Date of Patent: Aug. 18, 2009

(54) FOLDING CABINET BED WITH TELESCOPING SLIDE-OUT SUPPORT PLATFORM

(76) Inventors: Jon L. Arason, 707 Glendon Ave., Annapolis, MD (US) 21403; Jane A. Arason, 707 Glendon Ave., Annapolis, MD (US) 21403

( * ) Notice: Subject to any disclaimer, the term of this patent is extended or adjusted under 35 U.S.C. 154(b) by 23 days.

(21) Appl. No.: 11/399,897

(22) Filed: Apr. 7, 2006

(65) Prior Publication Data

US 2006/0225210 A1 Oct. 12, 2006

Related U.S. Application Data

(60) Provisional application No. 60/670,170, filed on Apr. 11, 2005.

(51) Int. Cl.

| | |
|---|---|
| ***A47C 19/00*** | (2006.01) |
| ***A47C 19/12*** | (2006.01) |
| *A47C 17/38* | (2006.01) |
| *A47C 17/04* | (2006.01) |

(52) U.S. Cl. ..... 5/159.1; 5/136; 5/18.1

(58) Field of Classification Search ..... 5/136, 5/18.1, 308, 58, 3–6, 133, 149, 157, 159.1, 5/160, 161

See application file for complete search history.

(56) References Cited

U.S. PATENT DOCUMENTS

| | | | | |
|---|---|---|---|---|
| 3,792 | A | 10/1844 | Kingman | |
| 67,816 | A | 8/1867 | Stock | |
| 83,936 | A | 11/1868 | Crosby | |
| 85,232 | A | 12/1868 | Maynard | |
| 95,076 | A | 9/1869 | Brander | |
| 107,881 | A | 10/1870 | Crosby | |
| 117,632 | A | 8/1871 | Hopf | |
| 119,079 | A | 9/1871 | Crosby | |
| 127,338 | A | 5/1872 | Goodrich | |
| 151,791 | A | 6/1874 | Mendum | |
| 157,719 | A | 12/1874 | Iverson | |
| 179,013 | A * | 6/1876 | Green | 5/152 |
| 179,513 | A | 7/1876 | Burr | |

(Continued)

FOREIGN PATENT DOCUMENTS

| | | |
|---|---|---|
| BE | 537992 | 5/1955 |

(Continued)

*Primary Examiner*—Peter M Cuomo
*Assistant Examiner*—Jonathan J Liu
(74) *Attorney, Agent, or Firm*—Whiteford, Taylor & Preston LLP; Jeffrey C. Maynard

(57) ABSTRACT

A folding cabinet bed includes a cabinet of sufficient size to enclose a standard size folded futon mattress, and allows the mattress to be deployed as a bed. Hinges on the front wall of the cabinet enable the front wall to fold down vertically. An extension panel attached to the front wall helps to create a sleeping platform that accommodates the mattress. A drawer with a plurality of nesting telescoping rails between the sidewalls of the cabinet and the sidewalls of the drawer is provided at the bottom of the cabinet. The telescoping rails enable the drawer to be extended away from the cabinet and support the front wall and extension panel to create a level sleeping surface. The drawer may include storage space for pillows and bedding. Latching means holds the cabinet closed to withstand outward pressure of the folded mattress. A safety chain or strap may be provided.

21 Claims, 8 Drawing Sheets

U.S. PATENT DOCUMENTS

| | | | | | |
|---|---|---|---|---|---|
| 186,632 | A | | 1/1877 | Smith | |
| 189,303 | A | | 4/1877 | Crosby | |
| 201,795 | A | | 3/1878 | Kiss | |
| RE8,375 | E | | 8/1878 | Kiss | |
| 218,678 | A | | 8/1879 | Koskul | |
| 224,679 | A | | 2/1880 | Green | |
| 239,805 | A | | 4/1881 | Knapp | |
| 253,903 | A | | 2/1882 | Witmer | |
| 306,894 | A | | 10/1884 | Balke | |
| 309,111 | A | | 12/1884 | Van Slyke | |
| 310,343 | A | | 1/1885 | Warren | |
| 322,177 | A | | 7/1885 | Goode | |
| 431,825 | A | | 7/1890 | Sundback | |
| 445,777 | A | | 2/1891 | Goodwillie | |
| 716,026 | A | | 12/1902 | Geisel | |
| 905,448 | A | | 12/1908 | Messel | |
| 1,170,149 | A | | 2/1916 | Gustafson | |
| 1,413,595 | A | * | 4/1922 | Kreuzkamp | 5/18.1 |
| 1,562,205 | A | | 11/1925 | Chempanos | |
| 2,265,671 | A | | 12/1941 | Quadri | |
| 2,356,321 | A | | 8/1944 | Irick | |
| 2,544,762 | A | | 3/1951 | Lochridge | |
| 2,547,863 | A | * | 4/1951 | Godschalk | 5/136 |
| 2,567,986 | A | | 9/1951 | Barrett | |
| 2,672,624 | A | | 3/1954 | Giuseffi | |
| 2,788,528 | A | | 4/1957 | Hansen | |
| 2,842,777 | A | | 7/1958 | Wheeler | |
| 3,353,865 | A | | 11/1967 | Bass | |
| 3,385,631 | A | * | 5/1968 | Gertler | 297/111 |
| 3,638,249 | A | | 2/1972 | Katsigarakis | |
| 3,858,253 | A | * | 1/1975 | Lauzon | 5/2.1 |
| 3,965,498 | A | * | 6/1976 | Boni | 5/6 |
| 3,965,798 | A | * | 6/1976 | Estlick | 91/172 |
| 4,793,011 | A | * | 12/1988 | Eve | 5/136 |
| 4,999,865 | A | | 3/1991 | Sauder et al. | |
| 5,036,558 | A | * | 8/1991 | Lameka et al. | 5/136 |
| 5,400,447 | A | | 3/1995 | Pokorny | |
| 5,440,768 | A | | 8/1995 | Danin | |
| 5,611,414 | A | | 3/1997 | Walker | |
| 5,652,978 | A | * | 8/1997 | Wiig | 5/144 |
| 5,913,769 | A | | 6/1999 | Byma et al. | |
| 5,950,257 | A | | 9/1999 | Smith et al. | |
| 6,401,276 | B1 | * | 6/2002 | Sherman | 5/136 |
| 6,463,603 | B1 | * | 10/2002 | Camfield | 5/18.1 |
| 6,851,139 | B2 | | 2/2005 | Arason et al. | |
| 7,013,506 | B2 | | 3/2006 | Revels | |

FOREIGN PATENT DOCUMENTS

| | | |
|---|---|---|
| FR | 921.179 | 4/1947 |
| FR | 1.084.476 | 1/1955 |
| FR | 1.369.358 | 7/1964 |
| GB | 2103 | 12/1893 |
| GB | 726249 | 3/1955 |
| IT | 534716 | 10/1955 |

* cited by examiner

FOLDING CABINET BED WITH TELESCOPING SLIDE-OUT SUPPORT PLATFORM

CROSS REFERENCE TO RELATED APPLICATION

This application is based upon and claims benefit of copending and co-owned U.S. Provisional Patent Application Ser. No. 60/670,170 entitled "Folding Cabinet Bed", filed with the U.S. Patent and Trademark Office on Apr. 11, 2005 by the inventors herein, the specification of which is incorporated herein by reference.

BACKGROUND OF THE INVENTION

1. Field of the Invention

The present invention relates to furniture and more particularly pertains to a cabinet that can house a folding mattress and allows the mattress to be deployed as a bed.

2. Background of the Prior Art

The broad concept of a cabinet bed is not new. Nevertheless, prior cabinet beds tended to suffer from one or more of several disabilities that limited their usefulness; for example, bulky and un-prepossessing appearance, complicated mechanism and inconvenient operation to deploy into a bed rendering it difficult to fold and unfold the bed and compounding its costs, unstable sleeping platform upon deployment, lack of storage drawers, significant lack of comfort, and other problems.

These disabilities are obvious to the extent that, though the demand for space-saving beds is high, there is a dearth of cabinet beds available today.

U.S. Pat. No. 3,638,249 to Katsigarakis, as well as several other U.S. and foreign patents, suffer from the similar disability of having the front and back panels of the cabinet hinged to a central base from which deployment of the sleeping platform is accomplished, with or without mechanical mechanisms, by folding the front and back panels into a horizontal position to create a mattress platform. This basic method of deployment is such that there can be no functioning storage drawers and that any objects placed on top of the cabinet when in the closed position must be removed prior to deployment into a bed.

U.S. Pat. No. 186,632 to Smith; U.S. Pat. No. 189,303 to Crosby; and U.S. Pat. No. 239,805 to Knapp all describe a cabinet bed in which the front of the cabinet folds out into a horizontal position to create a sleeping platform supported by a 'foot' at the end of the front panel. The 'foot' is hinged to the front panel and is folded downward and held in place to support the mattress platform at the same height as the base of the cabinet. These suffer from the similar disability of deploying the bed, such that the mattress deploys with the front panel thereby creating additional weight in addition to which, once in the horizontal position, the person deploying the bed must support the weight of both the panel and mattress while ensuring that the 'feet' are securely in place.

U.S. Pat. No. 1,170,149 to Gustafson is a cabinet bed that deploys using a two-piece platform that nests into each other. The cabinet mattress platform is supported by a pair of hinged legs that rotate downward to provide support where the two-pieces of the platform nest. Another piece on a hinge and spring rotates out and down to support the foot of the bed. The Gustafson cabinet suffers from a number of disabilities including: a complicated mechanism requiring stop pins and angle irons to prevent the foot from going beyond the vertical position; lack of storage drawers; lack of continuous support of the mattress platform, a mattress platform that deploys close to the floor; and an overall design that requires any number of independent actions to safely deploy the platform and mattress, making it unwieldy and difficult to deploy.

While each of the above mentioned devices may be effective to some degree in providing a folding cabinet bed, none of the references disclose a simple cabinet with few moving parts that can open to reveal a platform bed of any height supporting a variety of mattresses in a variety of sizes and containing storage drawers accessible in an open or closed position.

SUMMARY OF THE INVENTION

The present invention provides a solution to the above and other problems by enabling a simply designed folding cabinet bed with a telescoping drawer/bed frame assembly in an attractive piece of furniture that opens into a full-length platform bed of any height off the floor that can be configured to fit a mattress of any size.

It is, therefore, an object of the present invention to enable a folding cabinet bed that avoids the disadvantages of the prior art.

It is another object of the present invention to enable a folding cabinet bed that presents a decorative appearance in the closed configuration. A further related object of the present invention is to enable a folding cabinet bed having a simple design.

It is another object of the present invention to enable a folding cabinet bed with a telescoping frame to support the sleeping platform that closes into a compact configuration within the cabinet and extends to the desired length of the sleeping platform. A related object is to enable a folding cabinet bed having a telescoping drawer/bed frame assembly that is compact and easy to construct. A further related object is to enable a folding cabinet bed having a telescoping drawer/bed frame assembly in which the telescoping rail mechanism can be constructed using readily available hardware such as drawer slides or similar mechanisms, or can be constructed using dadoes with mating runners in and on the rails themselves with a pin-in-dado or other mechanism to ensure that the rails extend to the proper length to accomplish the telescoping and accommodate the mattress platform.

It is another object of the present invention to enable a folding cabinet bed with a telescoping frame in which the telescoping frame can be easily configured to adapt to any desired height for the sleeping platform. A related object of the present invention is to enable a folding cabinet bed with a telescoping frame in which the telescoping rails provide continuous support for the sleeping platform and are configured to support the sleeping platform on both sides and in the middle. A further related object is to enable a folding cabinet bed having a telescoping drawer/bed frame assembly in which the telescoping frame houses drawers that nest into the frame when in the closed position, and that are easily accessible whether the cabinet is closed or in a fully opened position.

It is another object of the present invention to enable a folding cabinet bed that can be securely latched when closed to withstand the outward pressure of the folded mattress. It is a related object of the present invention to enable a folding cabinet bed that has an internal latching mechanism to prevent accidental deployment of the mattress platform.

It is another object of the present invention to enable a folding cabinet bed wherein the interior of the cabinet is configured with an interior stretcher between side panels that can hold the mattress inside the cabinet while the frame and platform are being deployed thus removing the additional weight of the mattress during bed deployment.

It is another object of the present invention to enable a folding cabinet bed having a damper, spring, or other such device that can be easily installed to assist in the deployment of the front panel.

It is yet another object of the present invention to enable a folding, telescoping frame cabinet bed that may be easily and efficiently manufactured and marketed. A related object of the present invention is to enable a folding, telescoping frame cabinet bed that is susceptible of a low cost of manufacture with regard to both materials and labor, and which accordingly is then susceptible of low prices of sale to the consuming public, thereby making such a folding cabinet bed economically available to the buying public.

It is another object of the present invention to enable a folding, telescoping frame cabinet bed comprising an attractive cabinet enclosure and a mattress.

In accordance with the above and other objects, a cabinet bed having a telescoping frame and separately deploying platform is described for providing a piece of furniture that opens to a full-length bed in an attractive chest with a small footprint. The invention comprises a top cabinet that houses a mattress and a base assembly that houses a support mechanism, which allows the mattress to be deployed as a bed. The cabinet is deep and tall enough to enclose a folded mattress and of sufficient width to accommodate standard sizes of mattresses, with or without a separate mattress platform. Hinges on the bottom of the front wall of the cabinet enable the cabinet to be opened vertically so that the front wall folds down to a sleeping position. A separate extension panel, connected to the front wall, further deploys to create a sleeping platform of desired length to accommodate the mattress. Dampers, springs, or other mechanical devices can be installed to assist in lowering or raising the front cabinet wall. When folded down, the front cabinet wall and extension panel rest on a frame consisting of a plurality of nesting rails attached to the sidewalls and center support of the cabinet that telescope outward. Drawers are provided that nest within the telescoping rails. The rails and drawers are supported by casters to enable the drawers and rails to be extended away from the cabinet and to create a level frame to support the sleeping platform. In a closed position, the drawers and rails slide into the cabinet base. The drawers may also include storage space for pillows, bedding, and the like. Latching means holds the cabinet securely closed to withstand the outward pressure of the folded mattress. A safety chain may be provided to prevent the front cabinet wall from falling if accidentally opened.

When closed, the cabinet conceals and protects a mattress and bedding in an attractive false-fronted chest with practical tabletop surface and well-appointed hardware. When opened, the cabinet provides twin, full, queen, or king-size sleeping comfort. The cabinet front, extension panel, and rails become the sleeping platform. The rails rest on casters on the floor and support the platform off the floor thereby providing further comfort. After use, simply fold the mattress, extension panel, and front wall into the cabinet, lock the side catches, and push the drawers and rails into the cabinet base.

When closed, the cabinet conceals and protects a mattress and bedding in an attractive false-fronted chest with practical tabletop surface and well-appointed hardware. When opened, the cabinet provides twin, full, queen, or king-size sleeping comfort, complete with headboard. The cabinet front, extension panel, and rails become the sleeping platform. The rails rest on casters on the floor and support the platform off the floor thereby providing further comfort. After use, simply fold the extension panel and front wall into the cabinet, lock the side catches, and push the drawers and rails into the cabinet base.

The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF EXEMPLARY EMBODIMENTS

Figure 1:
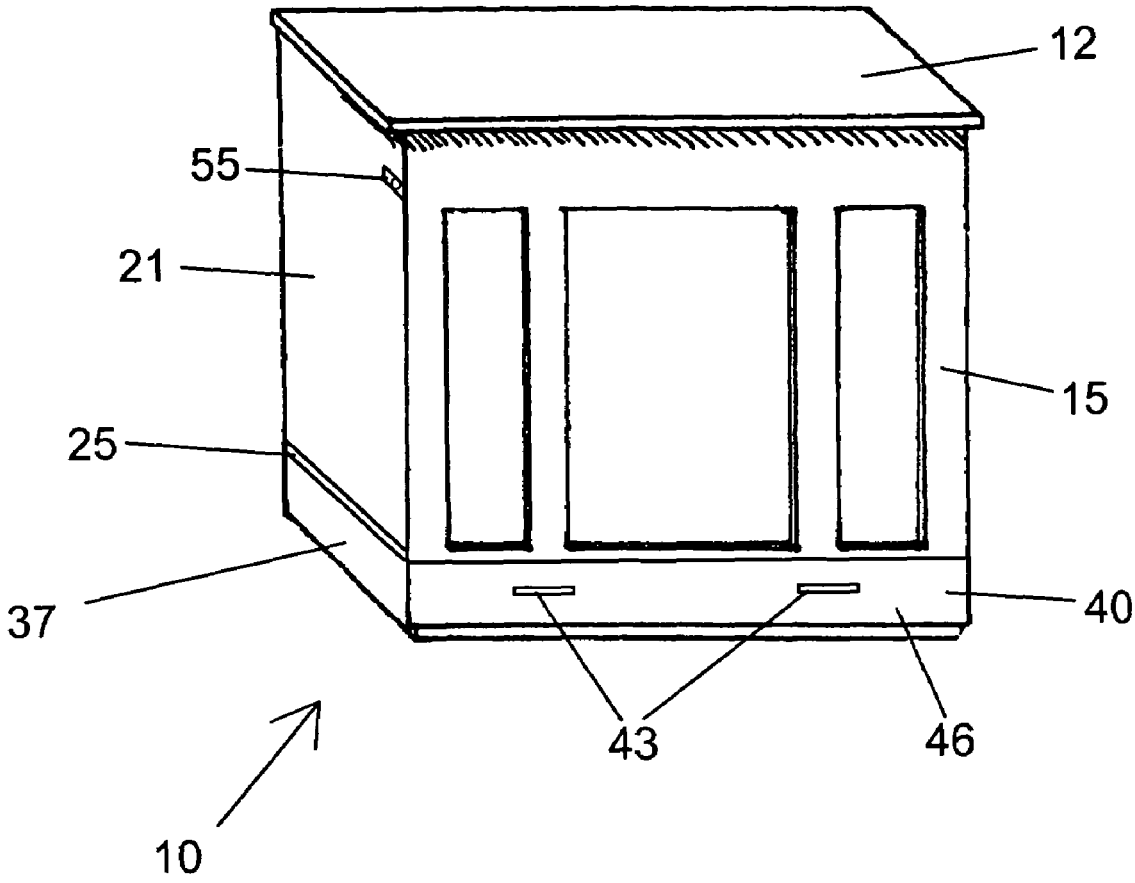
FIG. 1 illustrates a front perspective view of a folding cabinet bed according to an embodiment of the present invention.
Figure 2:
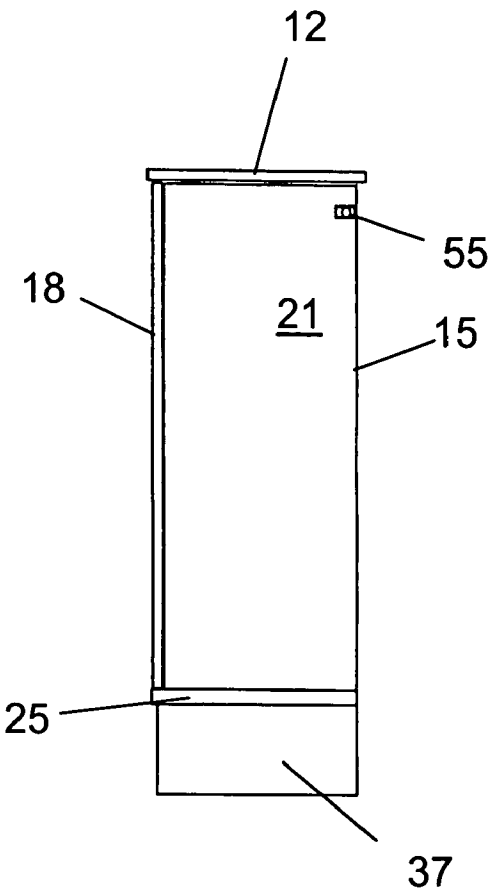
FIG. 2 illustrates a side elevational view of the folding cabinet bed in the closed configuration according to an embodiment of the present invention.
Figure 3:
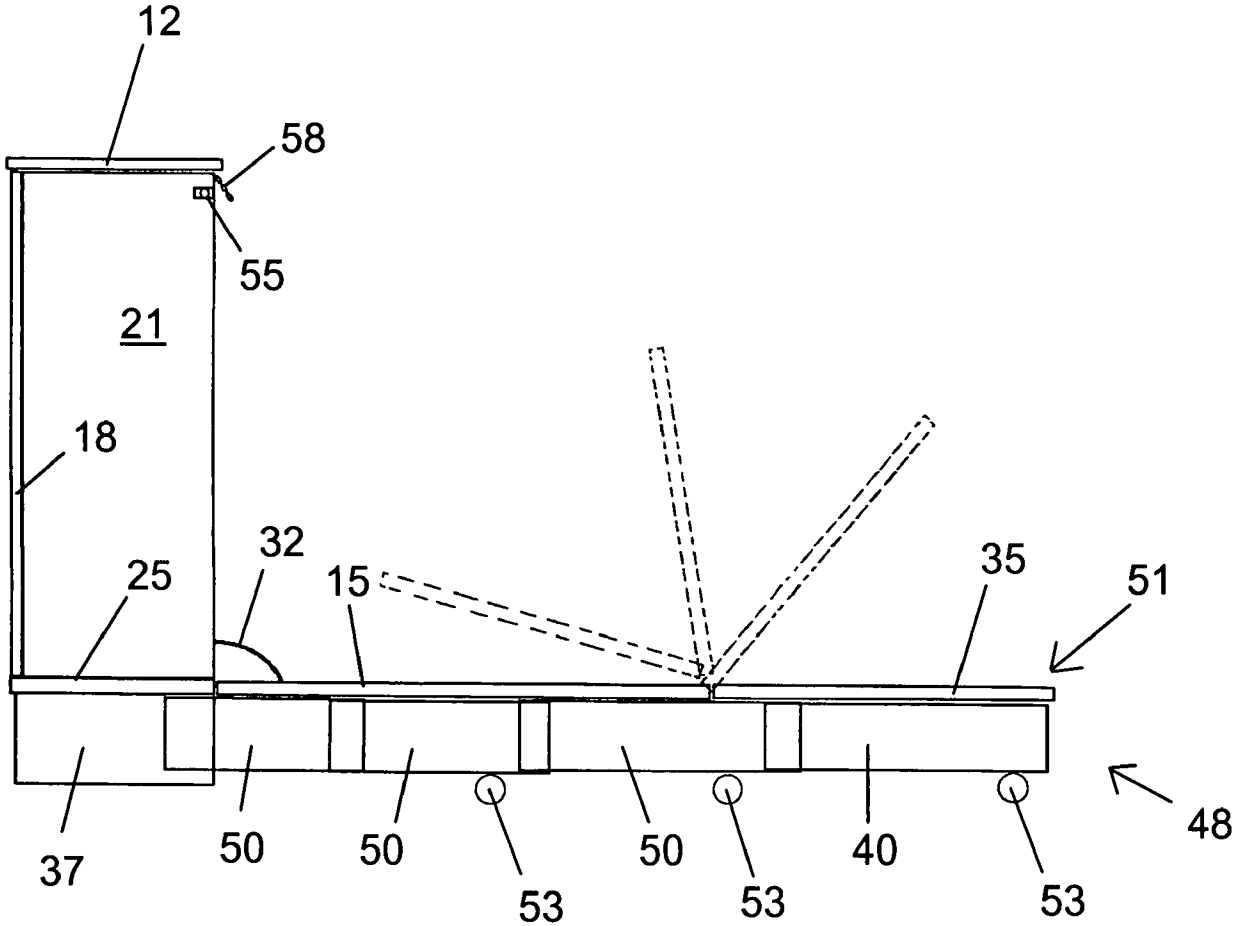
FIG. 3 illustrates a side elevational view of the folding cabinet bed in the open configuration according to an embodiment of the present invention.

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Referring to the drawings, FIGS. 1-5 show a cabinet, indicated generally as 10, according to an embodiment of the present invention. Cabinet 10 is constructed of solid wood, plywood, wood laminate, MDF, particleboard, or other common furniture construction materials. The cabinet 10 comprises a top panel 12, front wall 15, back wall 18, sidewalls 21, 22, and bottom panel 25. A stretcher 27 may be provided between sidewalls 21, 22 at the top of the cabinet 10. Front wall 15 is pivotably attached to the front edge of bottom panel 25 by hinge 30 at the bottom of front wall 15. In a preferred embodiment, a damper, spring, or other such device 32 can be installed to assist in the deployment of the front wall 15. While the term "front wall" is used herein to describe a main panel of a sleeping platform, as described below, it is contemplated that the front wall is not necessarily externally exposed when the cabinet 10 is in the closed position.

Figure 4:
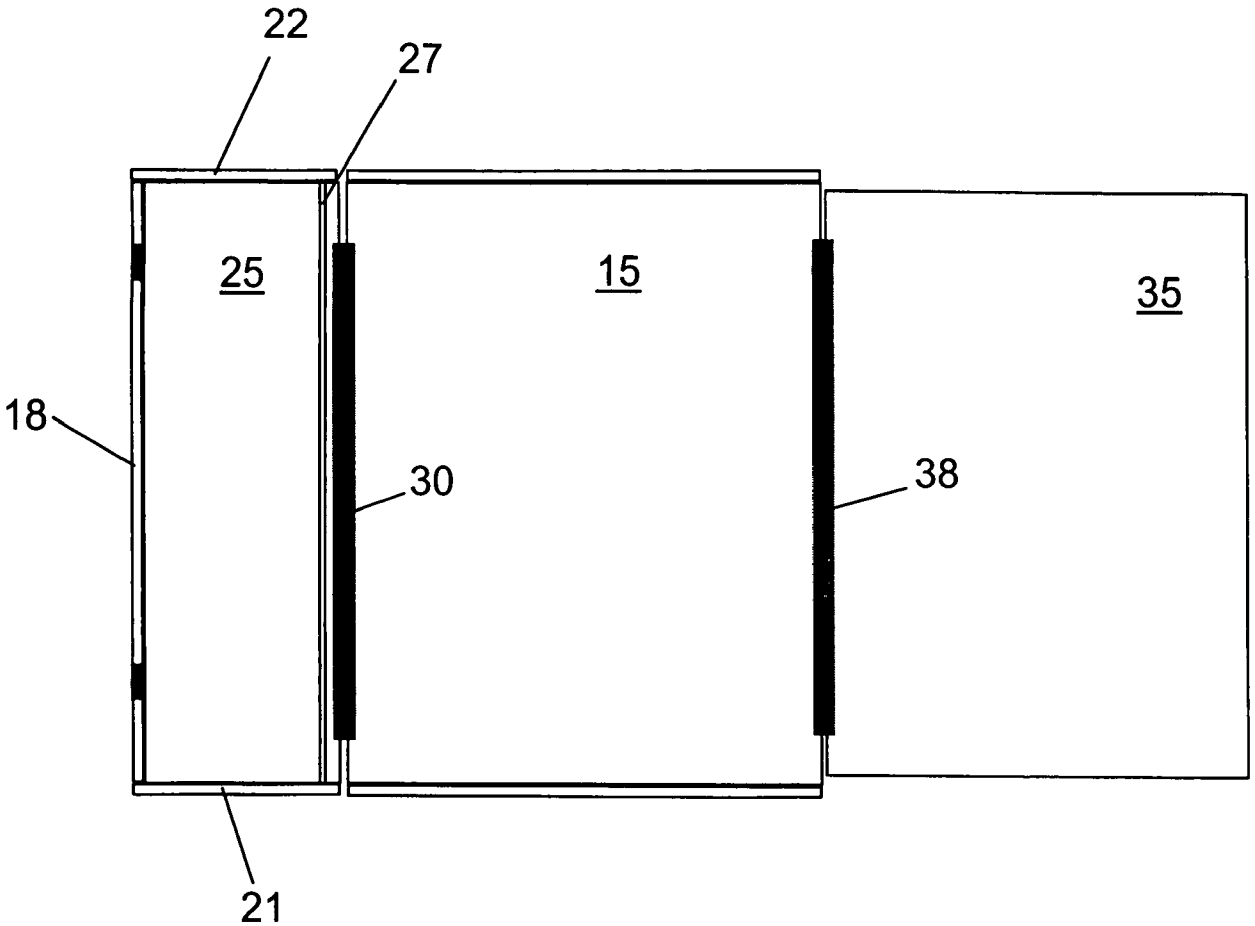
FIG. 4 illustrates a plan view of the folding cabinet bed in the open configuration according to an embodiment of the present invention.

An extension panel 35 is pivotably attached to the free end of the front wall 15 by hinge 38, as shown in FIG. 4. Hinges 30, 38 may comprise a single, long piano hinge or a plurality of smaller hinges. Extension panel 35 is sized and configured to fit between sidewalls 21, 22 so that extension panel 35 can fit inside the cabinet 10 in the closed configuration.

Figure 5:
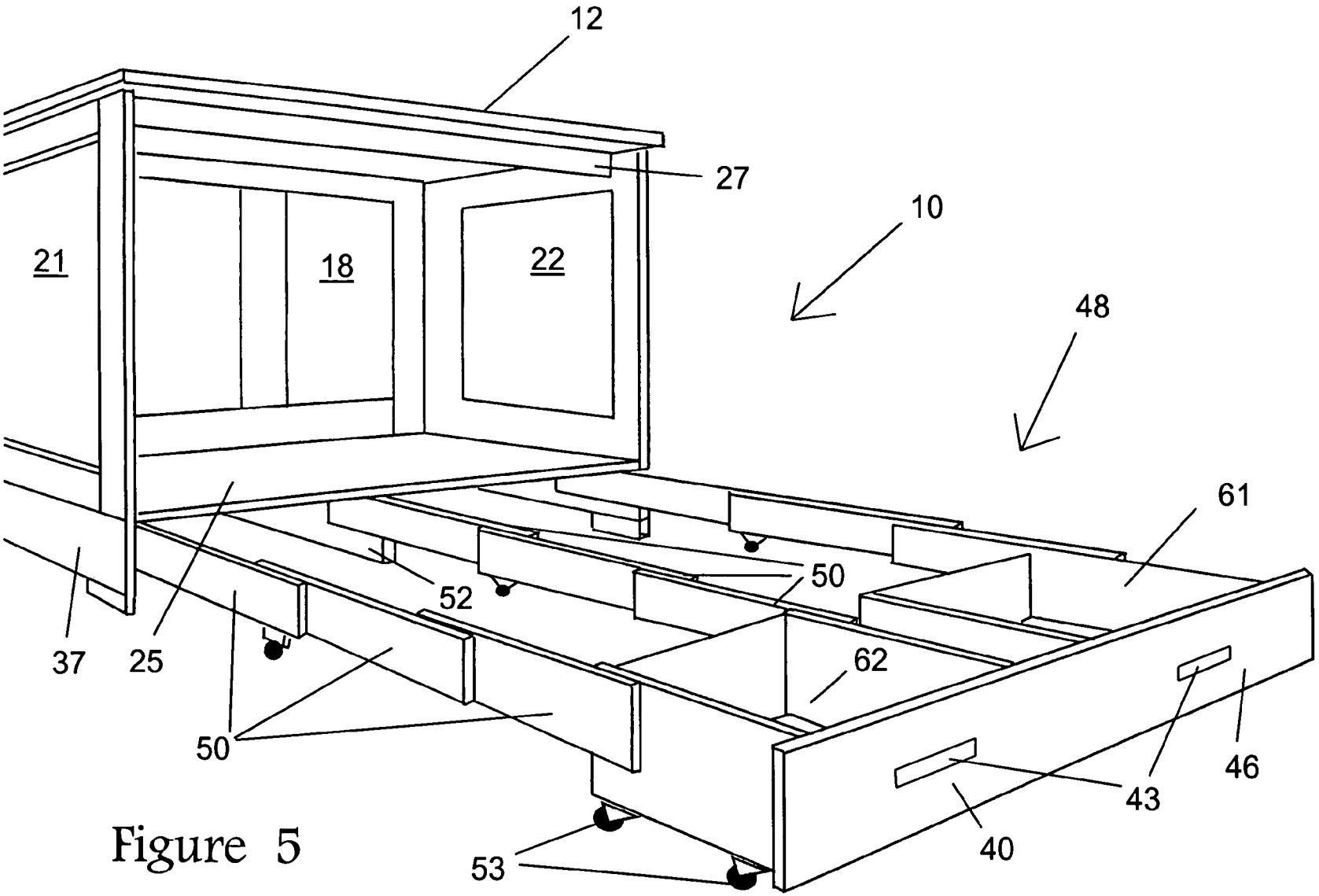
FIG. 5 illustrates a perspective view of the platform support structure of the folding cabinet bed in the open configuration, according to an embodiment of the present invention.
Figure 6:
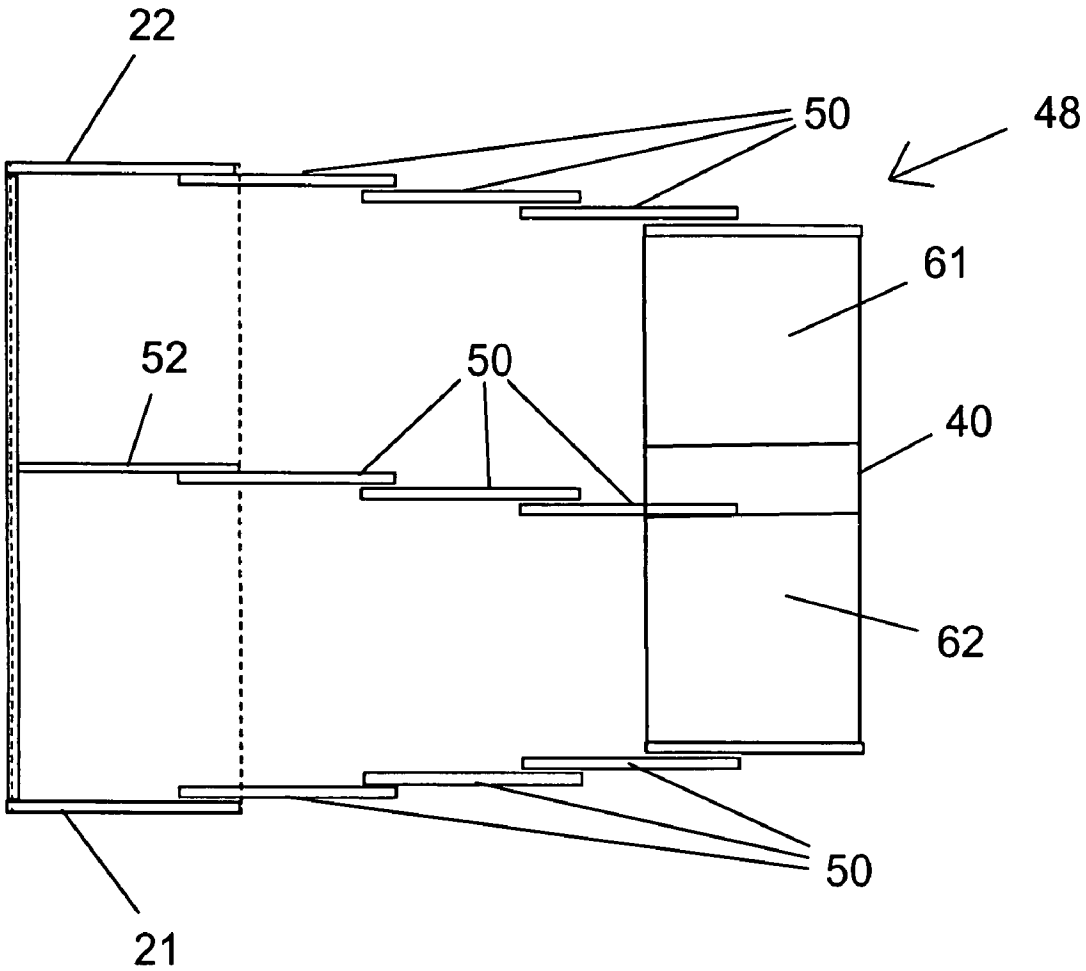
FIG. 6 illustrates a plan view of the platform support structure of the folding cabinet bed in the open configuration, according to an embodiment of the present invention.
Figure 8:
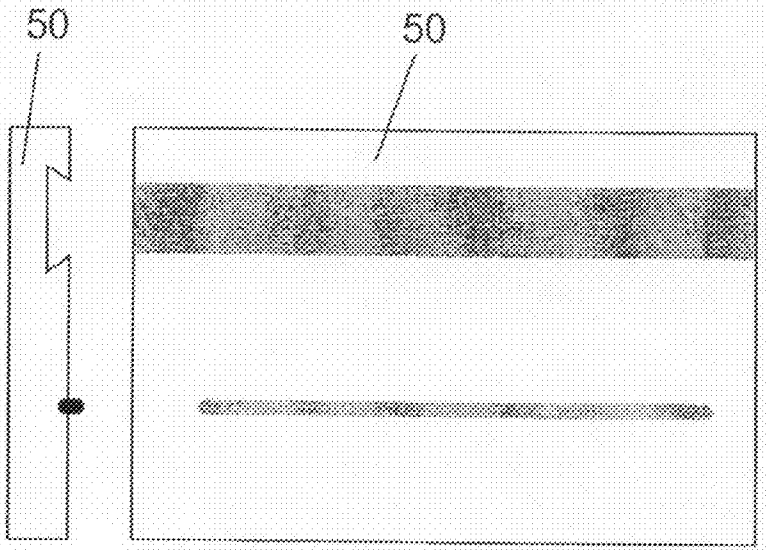
FIG. 8 illustrates a profile and elevational view of a nesting rail according to an embodiment of the present invention.
Figure 7:
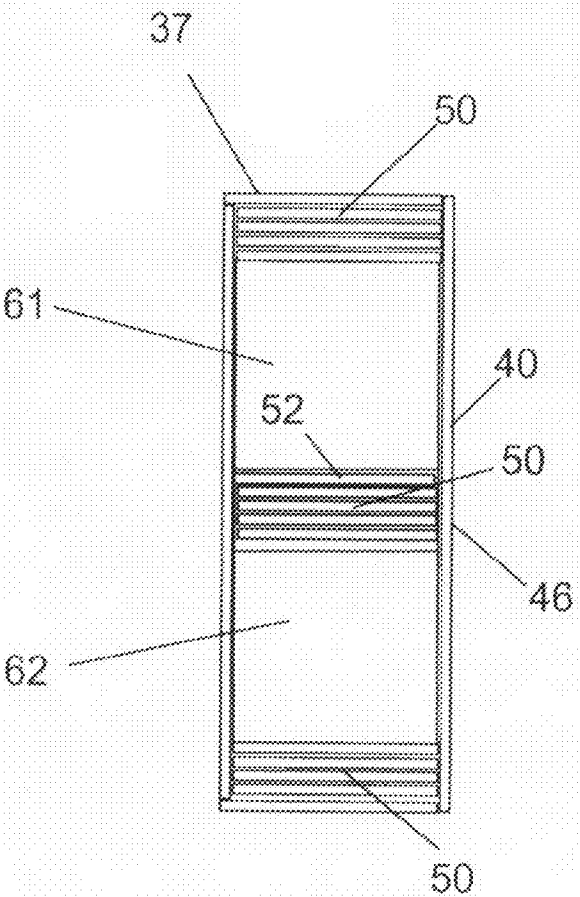
FIG. 7 illustrates a plan view of support members of the folding cabinet bed in the closed configuration, according to an embodiment of the present invention.

The cabinet 10 is mounted on a hollow base 37. A drawer 40 is provided in the base 37 below front wall 15 and under the bottom panel 25. At least one handle 43 is provided on the face 46 of drawer 40. The face 46 of drawer 40 extends the entire width of cabinet 10. A platform support structure 48 comprising a plurality of extendable telescoping rails 50 is provided within the base 37 between the sidewalls of the drawer 40 and the cabinet sidewalls 21, 22. The extendable rails 50 can be pulled out of the base 37 in a telescoping fashion approximately perpendicular to the base 37 to hold a bed platform 51, comprising the front wall 15 and extension panel 35, above the floor. In a preferred embodiment, at least three sets of telescoping rails 50 are provided to support the outside portions and center of the bed platform 51. A center support 52 may be provided under the bottom panel 25 between the sidewalls 21, 22. FIGS. 5 and 6 show the platform support structure 48 in the open configuration without the bed platform 51. One rail, typically the innermost rail, is attached to either compartment 61, 62 and the outer rails are attached to each side of drawer 40. The remaining rails 50 are nested together within the base 37, as shown in FIG. 7, which shows the rails 50 in the closed configuration. The length of the platform support structure 48 depends upon the number of rails 50, which is determined based upon the depth of the base 37 and the full open length of the bed platform 51. Nesting of the telescoping rails 50 can be accomplished using a dovetail arrangement, as shown in FIG. 8. Other methods of nesting the rails 50 may be used. For example, the telescoping rail mechanism can be constructed using readily available hardware such as drawer slides or similar devices, or can be constructed using dadoes with mating runners in and on the rails themselves with a pin-in-dado or other mechanism to ensure that the rails 50 extend to the proper length to accomplish the telescoping and accommodate the mattress platform 51.

Support structure 48 further comprises appropriate support mechanisms, such as casters 53, that elevate and carry the telescoping rails 50, and allow them to move easily in and out of the cabinet 10 by opening or closing the drawer 40. In an open configuration, the casters 53 provide support such that front wall 15, extension panel 35, and bottom panel 25 form a common plane above the floor or surface upon which the cabinet 10 is placed. When fully extended, the drawer 40, rails 50, and casters 53 hold up the front wall 15 and extension panel 35.

A pair of latching mechanisms 55 on each of sidewalls 21, 22 maintains the front wall 15 in the closed configuration. Drawer 40 may also be provided with a latching mechanism (not shown) to hold the drawer 40 in the open or closed position. Additionally, a safety chain 58 or strap may be provided to prevent the front wall 15 from falling if accidentally opened.

In a preferred embodiment, the cabinet 10 of the present invention is sized and configured to enable a mattress 60 to be enclosed within such cabinet 10. Cabinet 10 can be configured to hold a single-size, full-size, queen-size, or king-size mattress and may optionally include space for one or more pillows and bedclothes. Such pillows and bedclothes may be stored in compartments 61, 62 in the drawer 40. The stretcher 27 holds the mattress 60 inside the cabinet 10 while the support structure 48 and platform 51 are being deployed thus removing the additional weight of the mattress during bed deployment. Front wall 15 may be decorated to present an attractive appearance for a false cabinet or to mimic a piece of furniture, such as a chest of drawers, credenza, bureau, dresser, and the like.

In use, cabinet 10 can be opened vertically from top to bottom. First, the drawer 40 is pulled out to the full extent enabled by the rails 50. Next, the latching mechanisms 55 are released. If provided, the safety chain 58 is unhooked. Then, front wall 15 folds down and extension panel 35 is folded out to complete the length of the bed. The mattress 60 is exposed and can be opened to a sleeping position. In an open configuration, back wall 18 becomes the headboard of the bed, with top panel 12 overhanging. In such an embodiment, the cabinet 10 need not be moved away from a wall to open the cabinet 10 and extend the bed platform 51 to a full-sized bed. The support structure 48 enables the sleeping platform 51 to be in a raised position above the floor on which the cabinet 10 is placed.

In an alternate embodiment, extension panel 35 need not be pivotably attached to the front wall 15 and, instead, may be slidably connected to the inner surface of the front wall 15, by appropriate slides. When the front wall 15 is folded down to the sleeping platform 51, the extension panel 35 is slid out, parallel to front wall 15. At the end of its travel, extension panel 35 drops down or flips over to form a common plane with the front wall 15 on the sleeping platform 51.

In an alternate embodiment, extension panel 35 need not be pivotably attached to the front wall 15 and, instead, may be slidably connected to the inner surface of the front wall 15, by appropriate slides. When the front wall 15 is folded down to the sleeping platform 51, the extension panel 35 is slid out, parallel to front wall 15. At the end of its travel, extension panel 35 drops down to form a common plane with the front wall 15 on the sleeping platform 51.

Figure 9B:
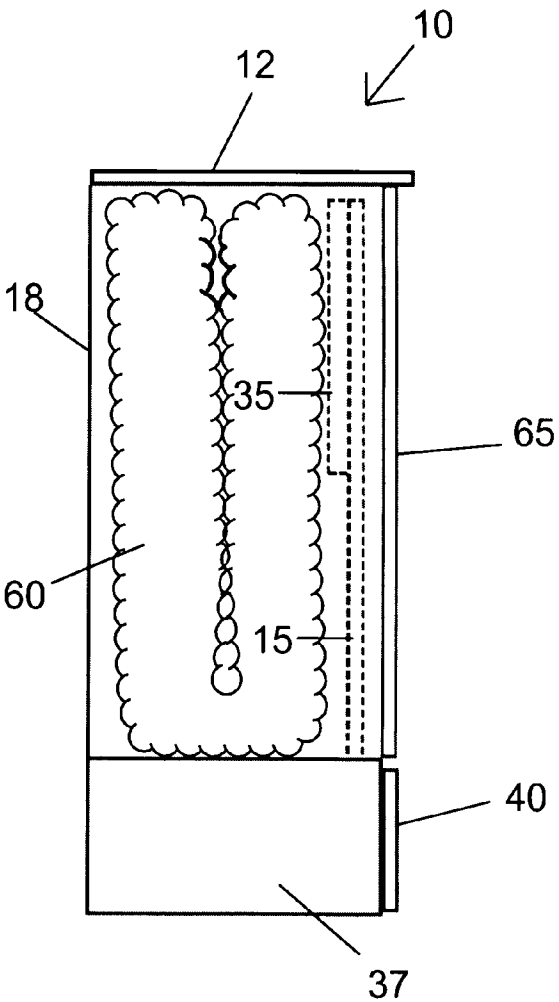
FIGS. 9*a* and *b* illustrates a front and side elevational view of a folding cabinet bed in the closed configuration according to a second embodiment of the present invention.
Figure 9A:
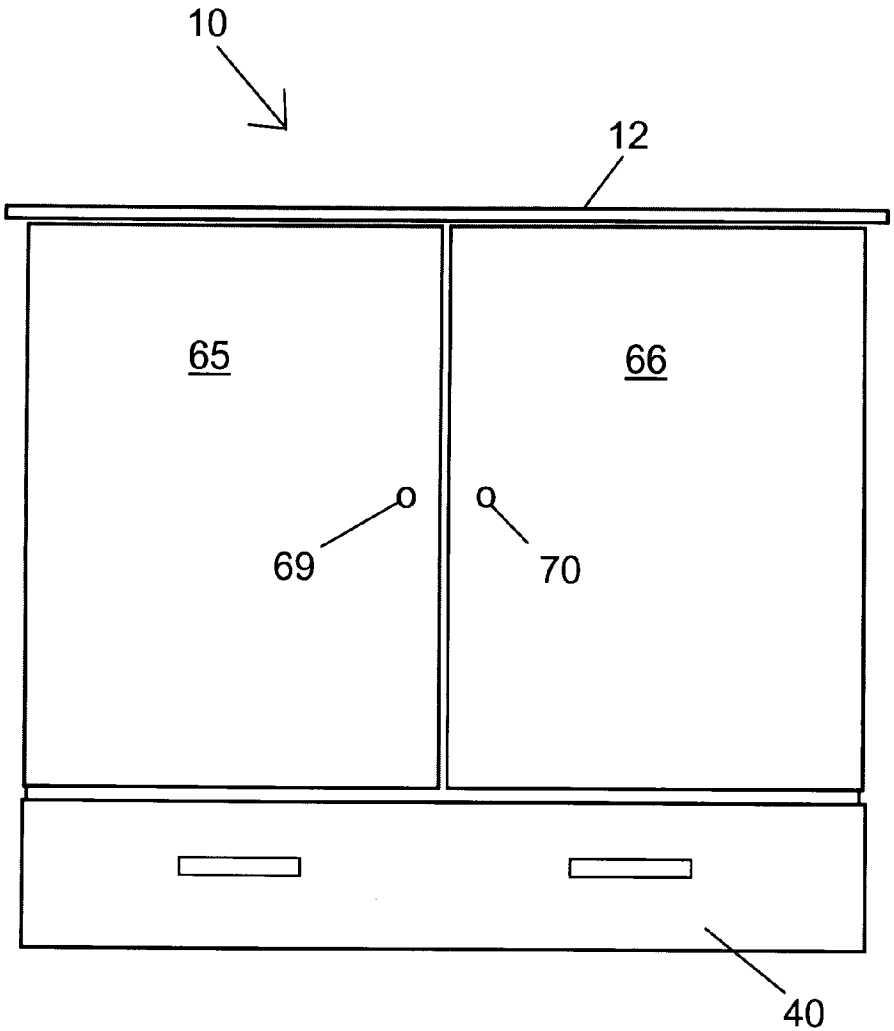

FIGS. 9*a* and *b* show cabinet 10 in an alternate configuration. The enclosure formed by the top panel 12, sidewalls 21, 22, and bottom panel 25 is closed by a pair of doors 65, 66 pivotably attached along a side edge of the doors 65, 66 to a forward edge of sidewalls 21, 22, respectively. A stretcher 27 may be provided between sidewalls 21, 22 at the top of the cabinet 10. Doors 65, 66 may include opening hardware, such as handles 69, 70. The front wall 15 is enclosed by the doors 65, 66. To create a sleeping platform, the front wall 15 is pivotably attached to the front edge of bottom panel 25 by hinge 30 at the bottom of the front wall 15. In a preferred embodiment, a damper, spring, or other such device can be installed to assist in the deployment of the front wall 15. In this configuration, the front wall 15 is sized and configured to fit between sidewalls 21, 22 so that the front wall 15 can fit inside the cabinet 10 in the closed configuration. A safety chain or latch may be provided to prevent the front wall 15 from falling when the doors 65, 66 are opened. Doors 65, 66 may be provided with a latching mechanism (not shown) to hold the doors 65, 66 in the open or closed position.

Figure 10:
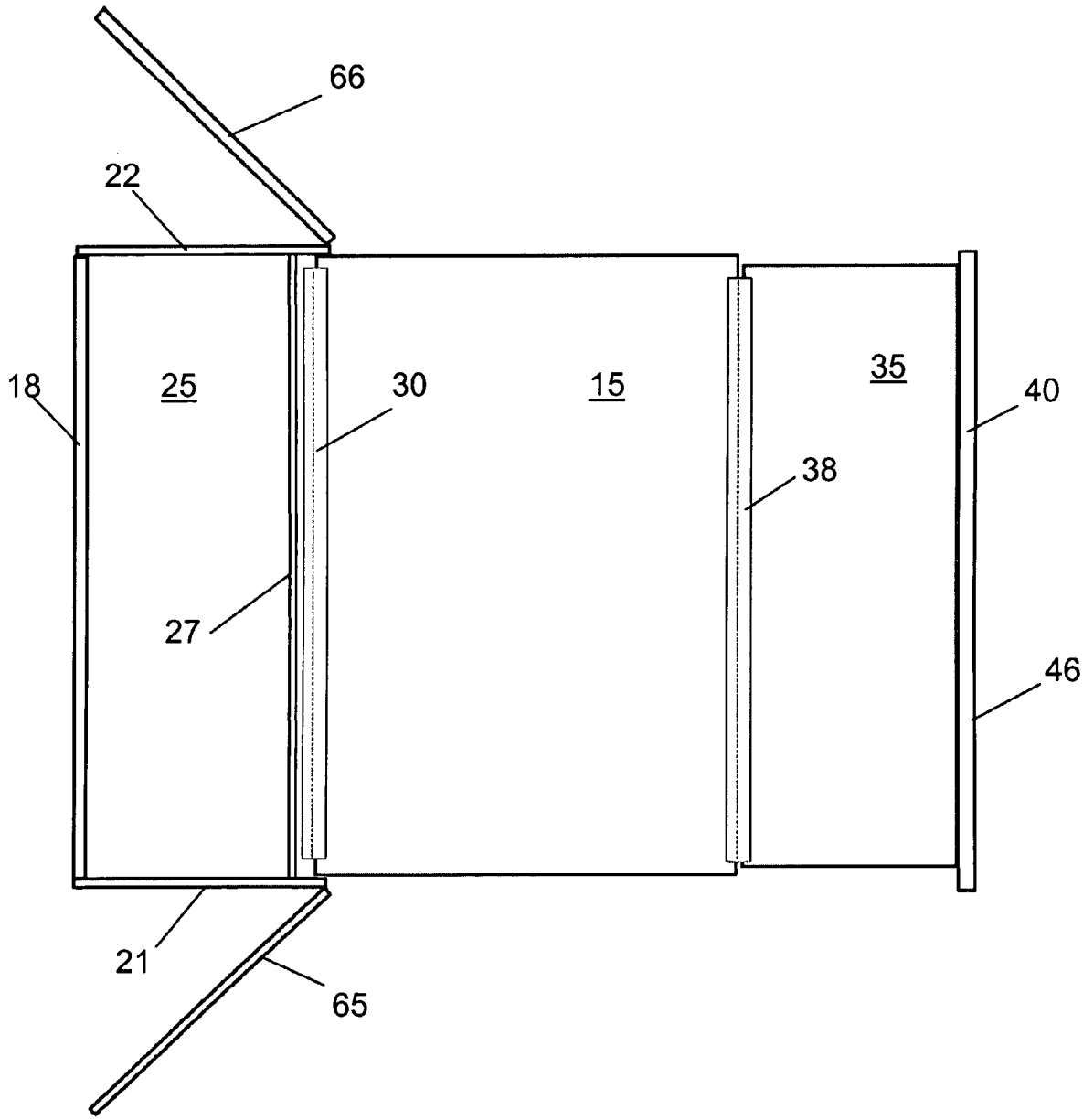
FIG. 10 illustrates a plan view of the folding cabinet bed in the open configuration according to a second embodiment of the present invention.

As in the previous configuration, the extension panel 35 is pivotably attached to the free end of the front wall 15 by hinge 38, as shown in FIG. 10. Hinges 30, 38 may comprise a single, long piano hinge or a plurality of smaller hinges. Extension panel 35 is likewise sized and configured to fit between sidewalls 21, 22 so that extension panel 35 can fit inside the cabinet 10 in the closed configuration. A platform support structure 48, as described above, is provided in the base 37 in this configuration, as well.

As described above, extension panel 35 need not be pivotably attached to the front wall 15 and, instead, may be slidably connected to the inner surface of the front wall 15, by appropriate slides. When the front wall 15 is folded down onto the platform support structure 48, the extension panel 35 is slid out, parallel to front wall 15. At the end of its travel, extension panel 35 drops down or flips over to form a common plane with the front wall 15.

To deploy the bed, the doors 65, 66 on cabinet 10 can be opened. First, the drawer 40 is pulled out to the full extent enabled by the rails 50 to deploy the platform support structure. Next, the latch or safety chain, if provided, is released. Then, front wall 15 folds down and extension panel 35 is folded out to complete the length of the bed and expose a mattress. The mattress can then be opened to a sleeping position.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It should be understood, therefore, that the invention may be practiced otherwise than as specifically set forth herein. Consequently, the present embodiments are to be considered in all respects as illustrative and not restrictive.

What is claimed is:

1. A folding cabinet bed system, comprising:

a cabinet assembly, comprising:

a top panel;

a back wall substantially perpendicular to said top panel, and having a first end, a second end, and two longitudinal side edges;

first and second spaced-apart sidewalls orthogonal to said top panel and said back wall, wherein a. said back wall is directly connected to said first and second sidewalls at said longitudinal side edges;

b. said back is directly connected to said top panel at said second end of said back wall; and c. said first and second sidewalls are directly connected at a top end to said top panel;

such that said top panel, said back wall, and said first and second sidewalls form a cabinet having a substantially rectangular compartment having an open bottom and an open front;

a base assembly, comprising:

a top piece;

a back piece;

two spaced-apart sidepieces orthogonal to said top piece and said back piece; and at least one support piece provided on an underside of said top piece between said two spaced-apart sidepieces, said support piece being sized and configured to prop up said top piece; and an extendable structure housed within said base assembly;

said extendable structure comprising:

at least one drawer on a front portion of said base assembly; and a plurality of telescoping rails attached to said at least one drawer and extendable approximately perpendicular to the front portion of said base assembly upon opening of said drawer;

wherein said cabinet assembly is sized and configured to be mounted on said base assembly; and a movable sleeping platform, comprising:

a front wall having a first end, a second end, and two longitudinal side edges, hingedly attached at said first end to a latitudinal front portion of said top piece of said base assembly, wherein said front wall is selectively movable between a closed vertical position and an open horizontal position; and an extension panel attached to said front wall and configured to make said front wall effectively longer, said extension panel being selectively movable between a closed position and an open position and when said extension panel is in the closed position, the extension panel is parallel to the front wall; and a mattress enclosed within said cabinet;

wherein said extendable structure supports said front wall and said extension panel when said front wall and said extension panel are in the open position, said plurality of telescoping rails being sized and configured to accommodate the size of the front wall and the extension panel.

2. The folding cabinet bed system of claim 1, further comprising:

at least one door, hingedly attached along a longitudinal side edge to a longitudinal side edge of one of the sidewalls, wherein said at least one door is selectively movable between a closed position and an open position.

3. The folding cabinet bed system of claim 2, wherein said at least one door encloses said front wall within the cabinet formed by said top panel, said back wall, said first and second spaced-apart sidewalls, and the top piece of the base assembly.

4. The folding cabinet bed system of claim 1, further comprising:

a plurality of support mechanisms mounted to said plurality of telescoping rails.

5. The folding cabinet bed system of claim 4, wherein said support mechanisms comprise casters.

6. The folding cabinet bed system of claim 1, wherein said at least one drawer comprises a storage compartment.

7. The folding cabinet bed system of claim 1, said at least one drawer having a first compartment and a second compartment and a separation between said first compartment and said second compartment.

8. The folding cabinet bed system of claim 7, said base assembly further comprising:

a first outer telescoping rail, a second outer telescoping rail, and an inner telescoping rail attached to said at least one drawer and extendable approximately perpendicular to the front portion of said base upon opening said drawer, wherein said inner telescoping rail is connected with said support piece and the separation between said first and second compartments is sized and configured to allow both said support piece and said inner telescoping rail to be accommodated within said separation when said drawer is in a closed position.

9. The folding cabinet bed system of claim 1, further comprising:

a stretcher connected between said first and second spaced apart sidewalls adjacent to said top panel, wherein the stretcher holds the mattress inside the cabinet when the front wall is moved to the open position.

10. The folding cabinet bed system of claim 1, further comprising:

a latching mechanism to releasably hold said front wall in the closed position.

11. The folding cabinet bed system of claim 10, further comprising:

a safety mechanism to permit said front wall to partly open but prevent said front wall from inadvertently deploying to a fully open position.

12. The folding cabinet bed system of claim 11, wherein said safety mechanism comprises a chain or strap.

13. The folding cabinet bed system of claim 1, further comprising:

a device to assist in deploying said front wall to the open position or to the closed position.

14. The folding cabinet bed system of claim 13, wherein said device comprises a damper or spring.

15. The folding cabinet bed system of claim 1, wherein said extension panel is narrower than said front wall.

16. The folding cabinet bed system of claim 1, wherein said extension panel is sized and configured to enable said extension panel to fit between said first and second spaced apart sidewalls when said front wall and said extension panel are in the closed position.

17. The folding cabinet bed system of claim 1, wherein said extension panel is hingedly attached at a first end to said second end of said front wall.

18. The folding cabinet bed system of claim 1, wherein said extension panel slides parallel to said front wall when moving from said closed position to said open position.

19. The folding cabinet bed system of claim 1, wherein said extension panel, said front wall, and said top piece of the base assembly lie in the same plane and cooperate with said support structure to form a level sleeping platform when said front wall and said extension panel are in the open position.

20. The folding cabinet bed system of claim 19, wherein said level sleeping platform is raised off the floor.

21. The folding cabinet bed system of claim 1, wherein said front wall is decorated to mimic a piece of furniture selected from the group consisting of:

a. chest of drawers;

b. credenza;

c. bureau; and d. dresser.

* * * * *